US011867492B2

(12) United States Patent
Eberhart

(10) Patent No.: US 11,867,492 B2
(45) Date of Patent: Jan. 9, 2024

(54) COMPOUND SHELL CASING, AND AMMUNITION HAVING COMPOUND SHELL CASING

(71) Applicant: Olin Corporation, St. Louis, MO (US)

(72) Inventor: Gerald Todd Eberhart, Bethalto, IL (US)

( * ) Notice: Subject to any disclaimer, the term of this patent is extended or adjusted under 35 U.S.C. 154(b) by 5 days.

(21) Appl. No.: 17/319,645

(22) Filed: May 13, 2021

(65) Prior Publication Data

US 2022/0011077 A1 Jan. 13, 2022

Related U.S. Application Data

(63) Continuation of application No. 15/956,860, filed on Apr. 19, 2018, now abandoned.

(60) Provisional application No. 62/487,476, filed on Apr. 19, 2017.

(51) Int. Cl.

| | |
|---|---|
| ***F42B 5/285*** | (2006.01) |
| ***F42B 5/02*** | (2006.01) |
| ***F42C 19/08*** | (2006.01) |

(52) U.S. Cl.

CPC ..... *F42B 5/285* (2013.01); *F42B 5/02* (2013.01); *F42C 19/083* (2013.01); *F42C 19/0823* (2013.01)

(58) Field of Classification Search

CPC .... F42B 5/26; F42B 5/28; F42B 5/285; F42B 5/02; F42B 5/30; F42B 5/307; F42B 5/313; F42C 19/083; F42C 19/08; F42C 19/0823

USPC ..... 102/464, 467, 468, 469, 470

See application file for complete search history.

(56) References Cited

U.S. PATENT DOCUMENTS

| | | | | |
|---|---|---|---|---|
| 640,856 A | | 1/1900 | Bailey | |
| 1,097,988 A | * | 5/1914 | Pedersen | F42B 5/36 102/470 |
| 2,862,446 A | * | 12/1958 | Ringdal | F42B 5/067 102/466 |
| 3,099,958 A | * | 8/1963 | Daubenspeck | F42B 7/06 86/19.5 |
| 3,498,221 A | | 3/1970 | Hilton | |

(Continued)

FOREIGN PATENT DOCUMENTS

| | | | | |
|---|---|---|---|---|
| CH | 263313 A | * | 8/1949 | F42B 5/285 |
| WO | WO-2018195242 A1 | * | 10/2018 | F42B 5/285 |

OTHER PUBLICATIONS

International Search Report and Written Opinion, PCT/US2018/028248 dated Jul. 13, 2018, (11 pages).

*Primary Examiner* — James S Bergin

(74) *Attorney, Agent, or Firm* — Harness, Dickey & Pierce, PLC

(57) ABSTRACT

A compound shell casing comprising:

a generally tubular outer member having an open forward end, an open rearward end, and a central passage extending therebetween, with a circumferentially extending, forwardly and inwardly facing seat in the rearward portion of the central passage;

an inner member disposed in the rearward end of the central passageway of the outer member, the inner member comprising a first forwardly facing cup-shaped portion, and a second, rearwardly facing cup-shaped portion opening to the open rearward end of the outer member, and a circumferentially extending downwardly and rearwardly facing shoulder on the exterior of inner member engaging the seat in the central passage of the outer member.

12 Claims, 6 Drawing Sheets

(56) References Cited

U.S. PATENT DOCUMENTS

| | | | | |
|---|---|---|---|---|
| 3,690,256 | A | 9/1972 | Schnitzer | |
| 3,744,420 | A | 7/1973 | Barr | |
| 3,745,924 | A * | 7/1973 | Scanlon | F42B 5/307 102/467 |
| 3,797,396 | A | 3/1974 | Reed | |
| 3,874,294 | A * | 4/1975 | Hale | F42B 33/001 102/467 |
| 3,977,326 | A | 8/1976 | Anderson et al. | |
| 5,969,288 | A | 10/1999 | Baud | |
| 7,213,519 | B2 | 5/2007 | Wiley et al. | |
| 9,003,973 | B1 | 4/2015 | Padgett | |
| 9,683,818 | B2 * | 6/2017 | Lemke | F42B 5/307 |
| 10,132,601 | B2 * | 11/2018 | Nemec | F42C 19/10 |
| 10,989,510 | B2 * | 4/2021 | Mohler | F42C 19/083 |
| 2007/0214992 | A1 | 9/2007 | Dittrich | |
| 2011/0179965 | A1 * | 7/2011 | Mason | F42B 5/307 102/466 |
| 2012/0180687 | A1 | 7/2012 | Padgett et al. | |
| 2014/0060373 | A1 | 3/2014 | Maljkovic et al. | |
| 2014/0224144 | A1 | 8/2014 | Neugebauer | |
| 2015/0300791 | A1 | 10/2015 | Eberhart | |

* cited by examiner

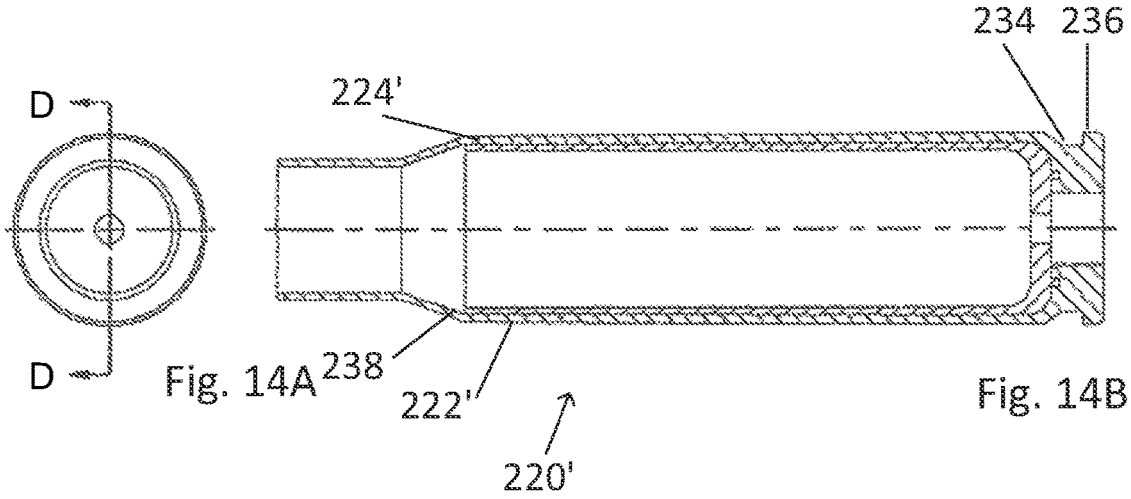
Fig. 14A
Fig. 14B
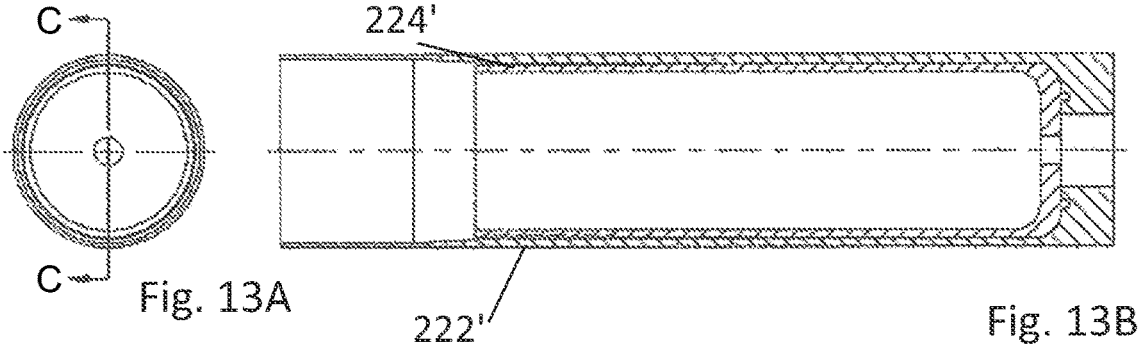
Fig. 13A
Fig. 13B
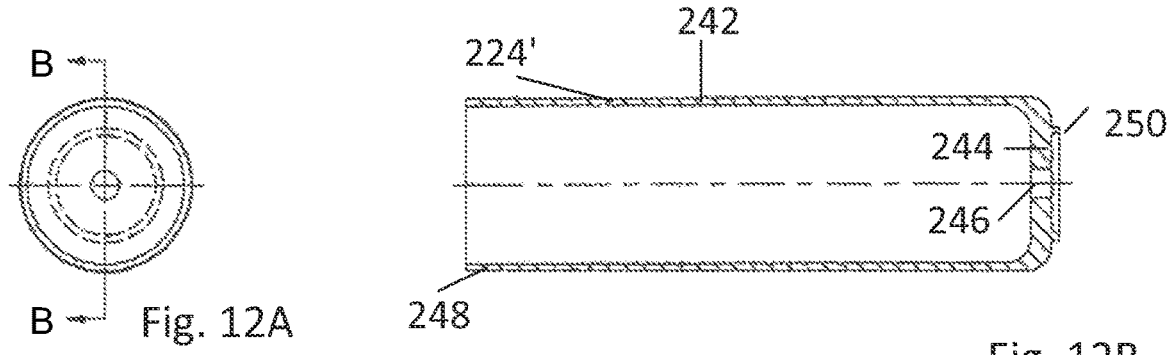
Fig. 12A
Fig. 12B
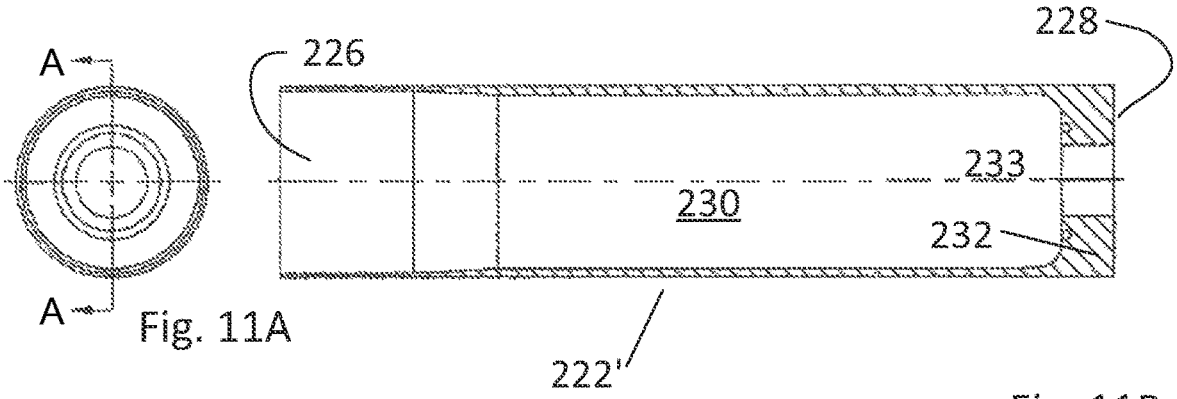
Fig. 11A
Fig. 11B

COMPOUND SHELL CASING, AND AMMUNITION HAVING COMPOUND SHELL CASING

CROSS-REFERENCED APPLICATION

This application is a continuation of U.S. patent application Ser. No. 15/956,860 filed Apr. 19, 2018. This application also claims the benefit of U.S. provisional application Ser. No. 62/487,476 filed on Apr. 19, 2017. The disclosure of the above-referenced application is incorporated herein by reference in its entirety.

FIELD

This invention relates to ammunition, and in particular a compound shell casing, and ammunition having a compound shell casing.

BACKGROUND

This section provides background information related to the present disclosure which is not necessarily prior art.

Ammunition cartridges have conventionally been made with a one-piece brass shell casing. Brass is used because it is particularly suitable to drawing and other processes used in making the shell casing. However brass is relatively heavy, making ammunition made with brass shell casings heavy. Brass is also relatively more expensive than many other materials that could be used. The problem is to provide a functional shell casing that can be made from lighter and/or less expensive materials, particularly materials that might not be as easily manipulated as brass.

SUMMARY

This section provides a general summary of the disclosure, and is not a comprehensive disclosure of its full scope or all of its features.

Embodiments of the present invention provide a compound shell casing that can be made lighter than conventional cartridges, yet which still provides safe and reliable operation, and is relatively simple manufacture. While the compound shell casing can be made of brass like conventional shell casings, some embodiments of the invention allow the compound shell casing to be made of other materials providing additional opportunities to reduce weight and/or cost.

A preferred embodiment of a compound shell casing in accordance with the principles of this invention comprises a generally tubular outer member having an open forward end, an open rearward end, and a central passage extending therebetween. This is a circumferentially extending, forwardly and inwardly facing seat in the rearward portion of the central passage. An inner member is disposed in the rearward end of the central passageway of the outer member. The inner member has a first, forwardly facing cup-shaped portion, and a second, rearwardly facing cup-shaped portion that opens to the open rearward end of the outer member. The inner member has a circumferentially extending downwardly and rearwardly facing face on its exterior that engages the seat in the central passage of the outer member.

The rearward end of the inner member is preferably substantially flush with the rearward end rear of the outer member, forming a part of the rearward end of the cartridge.

There is preferably an extractor groove in the outer member adjacent the rearward end, defining a rim at the rearward end of the outer member.

The outer member preferably has a shoulder adjacent the forward end, forming a neck portion at the forward end of the outer member, of a smaller diameter than the outer member rearward of the shoulder.

A preferred embodiment of an ammunition cartridge according the principles of this invention generally comprises a compound shell casing, fitted with a bullet in the neck of the casing, a primer fitted in the second cup shaped portion of the inner member, and propellant in the first cup portion of the inner member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 11A is a top plan view of the outer member of an alternate construction of the third preferred embodiment of a compound shell casing, before the formation of the neck in the outer member;

FIG. 11B is a longitudinal cross-sectional view of the outer member of the alternate construction of third preferred embodiment, take along the plane of line A-A in FIG. 11A;

FIG. 12A is a top plan view of the inner member of the alternate construction of the third preferred embodiment of a compound shell casing;

FIG. 12B is a longitudinal cross-sectional view of the inner member of the alternate construction of the third preferred embodiment, take along the plane of line B-B in FIG. 12A;

FIG. 13A is a top plan view of a third preferred embodiment of a compound shell casing, showing the inner member inside the outer member before formation of the neck in the outer member;

FIG. 13B is a longitudinal cross sectional view of the compound shell casing, taken along the plane of line C-C in FIG. 13A;

FIG. 14A is a top plan view of the alternate construction of the third preferred embodiment of a compound shell casing, showing the inner member inside the outer member after formation of the neck in the outer member;

FIG. 14B is a longitudinal cross sectional view of the compound shell casing, taken along the plane of line D-D in FIG. 14A.

Corresponding reference numerals indicate corresponding parts throughout the several views of the drawings.

DETAILED DESCRIPTION

Example embodiments will now be described more fully with reference to the accompanying drawings.

Figure 3A:
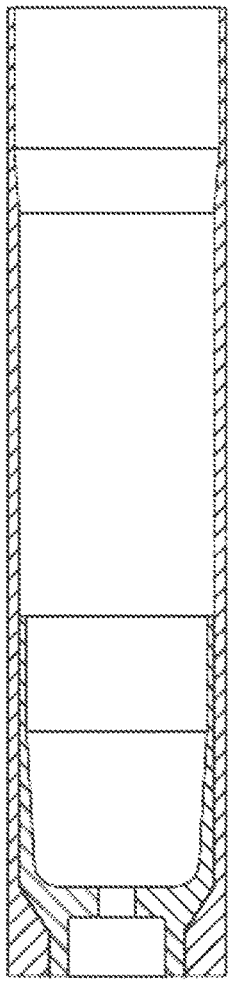
FIG. 3A is a longitudinal cross sectional view of the compound shell casing during one possible method of manufacture, showing casing after the inner member has been inserted in the outer member.
Figure 3B:
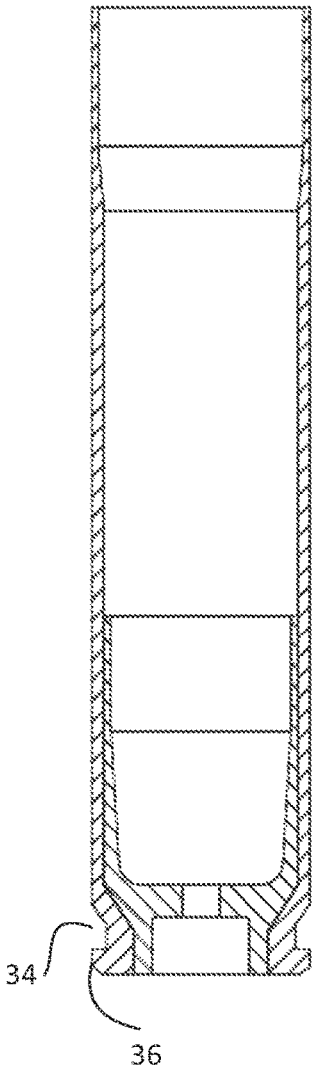
FIG. 3B is a longitudinal cross sectional view of the compound shell casing during one possible method of manufacture, showing the casing after the ejector groove has been formed in the outer member.
Figure 3C:
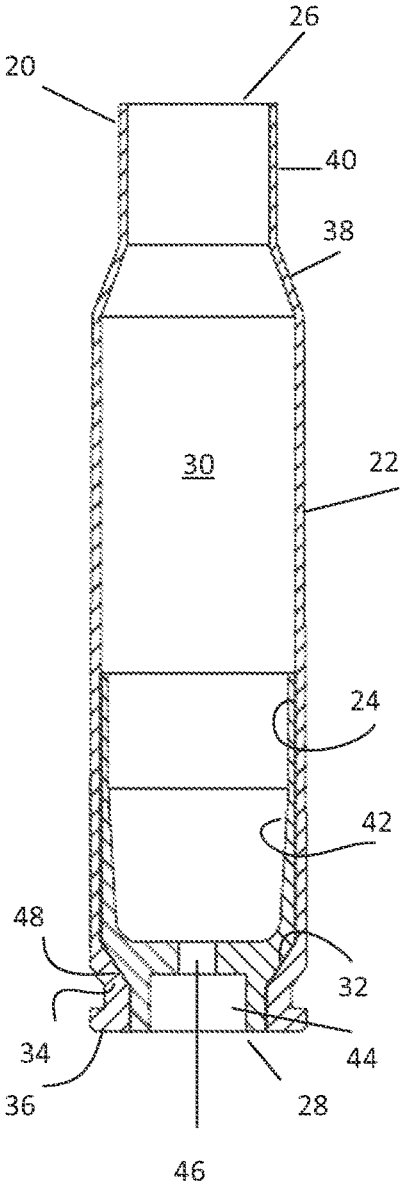
FIG. 3C is a longitudinal cross sectional view of the compound shell casing during one possible method of manufacture, showing the casing after a shoulder has been formed in the outer member.

A composite shell casing in accordance with the principles of this invention is indicated generally as 20 in FIG. 3C. The composite shell casing preferably comprises an outer member 22, and an inner member 24.

The outer member 22 is generally tubular, having an open forward end 26, an open rearward end 28, and a central passage 30. There is a circumferentially extending, forwardly and inwardly facing seat 32 in the rearward portion of the central passage 30. An extractor groove 34 can be formed in the exterior of the outer member, adjacent to, but spaced from the rearward end. The extractor groove 34 forms a rim 36 on the outer member 22, at the rearward end.

The outer member 22 preferably has a shoulder 38 adjacent the forward end 26, forming a neck portion 40 at the forward end of the outer member, of a smaller diameter than the outer member rearward of the shoulder. The shoulder 38 may be flat (as shown) or convexly curved or bowed.

The outer member 22 can be formed of a light weight material, preferably aluminum or an aluminum alloy. The outer member can be quickly and inexpensively formed by drawing.

The inner member 24 is disposed in the rearward end of the central passage 30 of the outer member 22. The inner member 24 comprises a first forwardly facing cup-shaped portion 42, and a second, rearwardly facing cup-shaped portion 44 opening to the open rearward end 28 of the outer member 22. There is a port 46 between the first cup portion 42 and the second cup portion 44. The inner member 24 has a circumferentially extending downwardly and rearwardly facing face 48 on its exterior, that engages the seat 32 in the central passage 30 of the outer member 22. The rearward end 50 of the inner member 24 is preferably substantially flush with the rearward end rear 28 of the outer member 22, forming a part of the rearward end of the shell casing.

Figure 1:
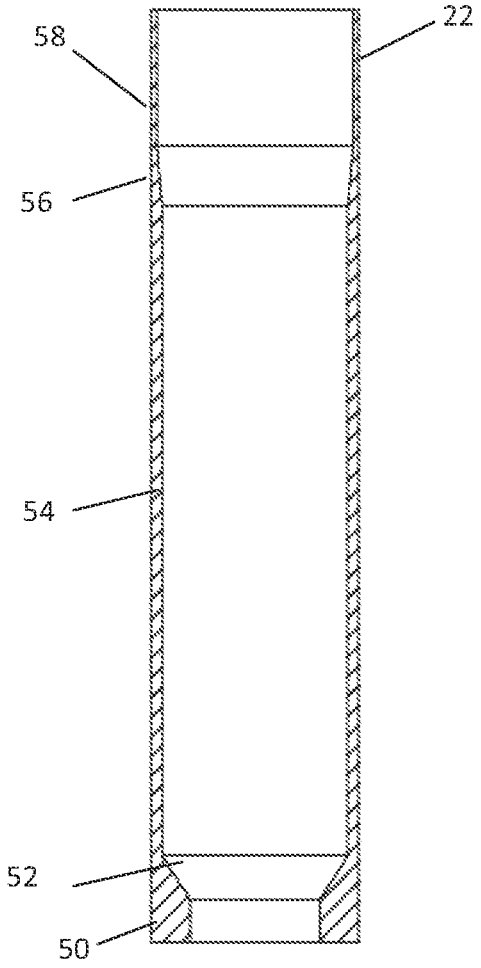
FIG. 1 is a longitudinal cross sectional view of the outer member of a preferred embodiment of a compound shell casing in accordance with the principles of this invention.
Figure 2:
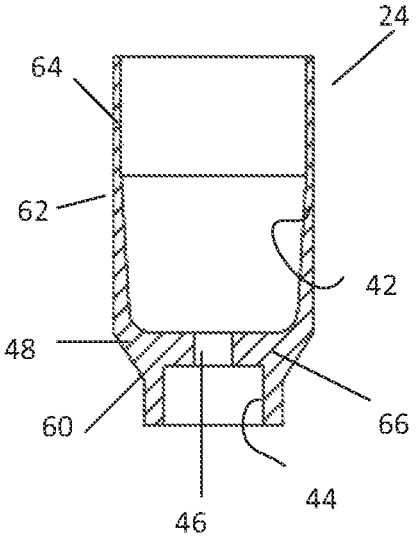
FIG. 2 is a longitudinal cross sectional view of the inner member of a preferred embodiment of a compound shell casing in accordance with the principles of this invention.

The inner member 24 is preferably made of a stronger, more temperature resistant alloy than the outer member 22. For example the inner member 24 could be made of steel, and preferably of a stainless steel. However the inner member could be of some other material, such as copper or copper alloys (such as brass or bronze), nickel or nickel alloys. The inner member can made by machining, cold forming (such as cold heading), or other suitable fabrication processes. The inner member 24 could even be made using a metal injection molding (MIM) process The casing 20 can be quickly and easily assembled from the separately manufactured outer member 22 (shown in FIG. 1) and the separately manufactured inner member 24 (shown in FIG. 2). As shown in FIG. 1, as manufactured the outer member 22 preferably starts with a smooth, continuous cylindrical sidewall, with a thick portion 50 at the rearward 28, end which has a sloped face 52 on the interior which forms the seat 32. The outer member 22 has a section 54 of substantially uniform thickness, a section 56 of tapering thickness, which will form the shoulder 38, and at the forward end a section 58 of substantially uniform thickness that forms the neck 40.

The inner member 24 has a section 60 of substantially uniform thickness forming the second, rearwardly facing cup portion 44, and sections 62 and 64 forming the walls of the first, forward facing cup portion 42. The section 62 has a tapering wall thickness, while the section 64 at the forward end of the inner member has a substantially uniform thickness. The bottoms of the first and second cup-shaped portions 42 and 44 are formed by a web 66 through which the port 46 extends. The face 48 is preferably generally adjacent the web 66.

As shown in FIG. 3A-3C, the compound casing is formed by positioning the inner member 24 inside the passage 30 of the outer member 22, with the face 48 engaging the seat 32. This helps engage the inner and outer members 24 and 22 from relative movement. The inner member 24 is preferably friction fit in the passage 30, but in some embodiments it could be secured by bonding or adhesives, or otherwise. As shown in FIG. 3B, after the inner member 24 has been installed in the outer member 22, an extractor groove 34 can be formed in the outer surface of the outer member, adjacent the rearward end 28, for example by cutting or milling, thereby forming rim 30 at the rearward end of the shell casing. As shown in FIG. 3C, after the extractor groove 34 has been formed, the shoulder 38 can be formed in the wall of the outer member 22, thereby forming the neck 40.

Figure 4:
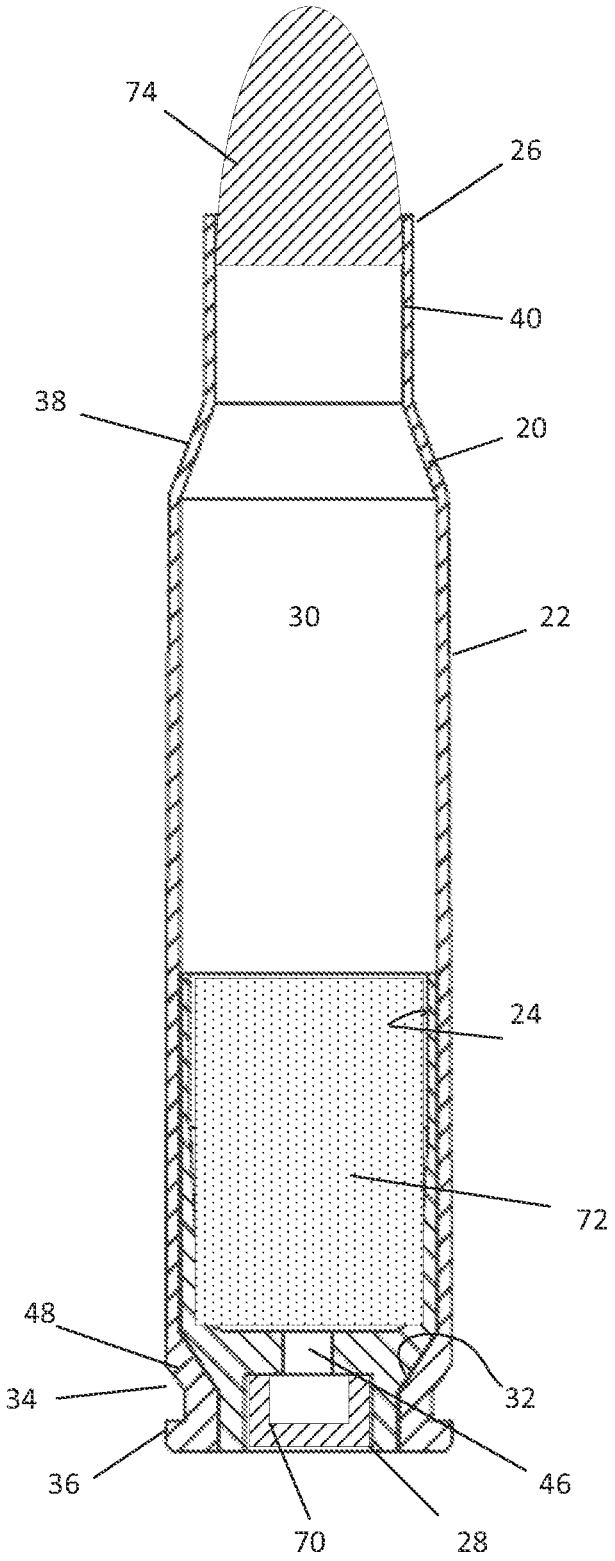
FIG. 4 is a cross sectional view of a preferred embodiment of an ammunition cartridge with a compound shell casing in accordance with the principles of this invention.

The completed compound shell casing is ready for assembly into an ammunition cartridge. As shown in FIG. 4, a primer 70 is friction fit into the second cup-shaped portion 44 of the inner member 24, propellant 72 is loaded into the first cup shaped portion 42 of the inner member, and a bullet 74 is seated in the neck 40.

Of course the outer and inner members 22 and 24 can be made of any suitable materials, including polymers, composites, and metals, including conventional brass. However in the preferred embodiment the outer member 22 as well as the inner member 24 are preferably made of aluminum which is lighter and typically less expensive than brass. The weight is preferably reduced between about 12 and about 60 percent. For example, in one preferred embodiment, a compound casing for a 7.62 mm round made of aluminum and steel might weigh 101 grains, compared to about 182 grains for a comparable conventional brass shell of the same caliber, or a 44.5% reduction in weight. Compound casings for other calibers would provide similar weight reductions.

Figure 5A:
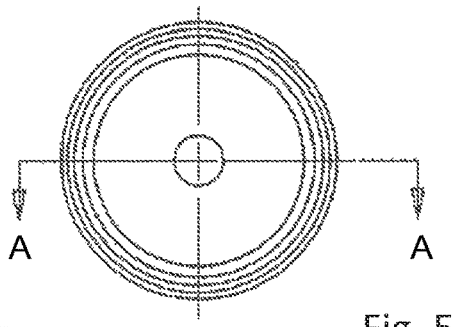
FIG. 5A is a top plan view of a second preferred embodiment of a compound shell casing, showing the inner member inside the outer member before formation of the neck in the outer member.
Figure 6A:
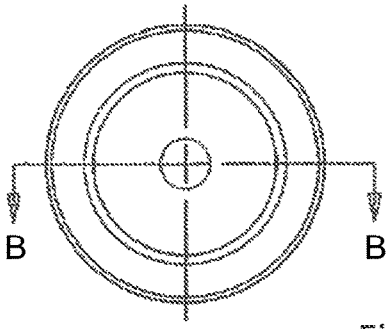
FIG. 6A is a top plan view of a second preferred embodiment of a compound shell casing, showing the inner member inside the outer member after formation of the neck in the outer member.
Figure 5B:
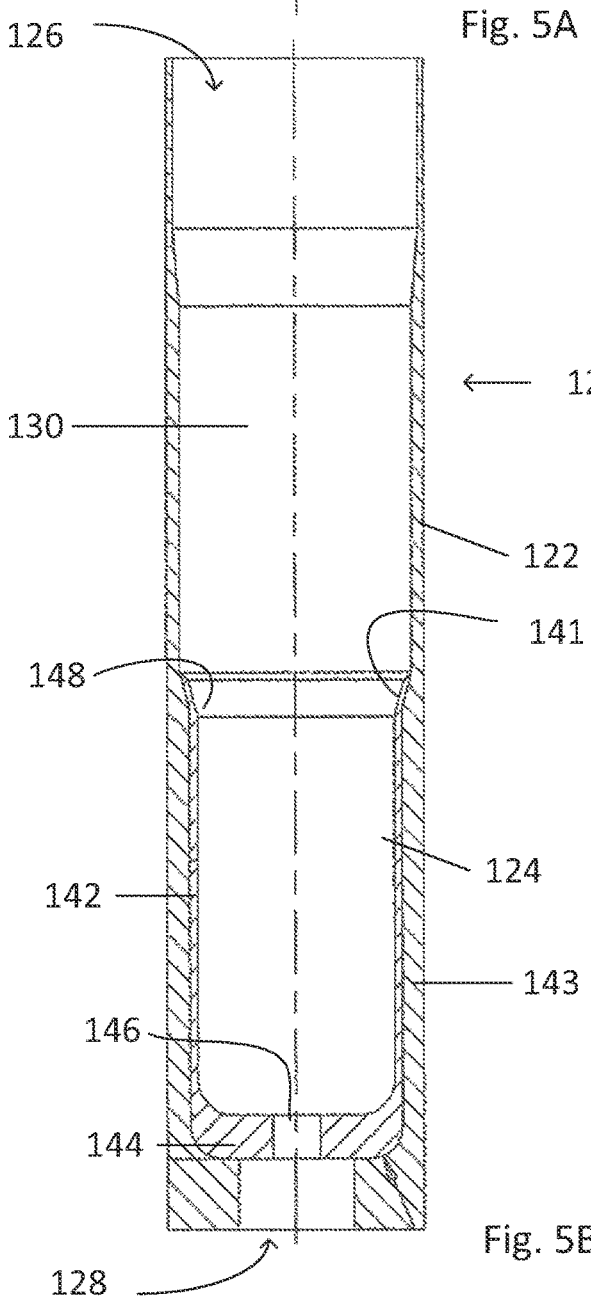
FIG. 5B is a longitudinal cross sectional view of the compound shell casing, taken along the plane of line A-A in FIG. 5A.
Figure 6B:
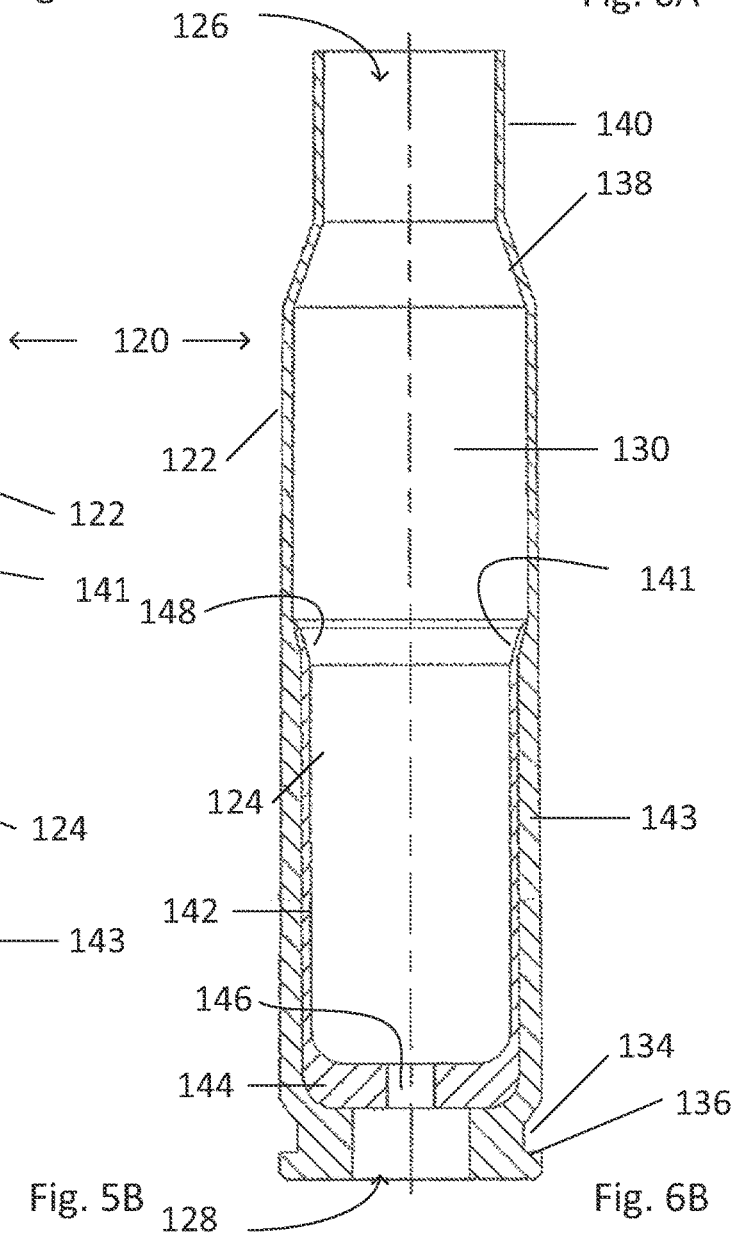
FIG. 6B is a longitudical cross sectional view of the compound shell casing, taken along the plane of line B-B in FIG. 6A.

A second preferred embodiment of a compound shell casing is indicated generally as 120 in FIGS. 5 and 6, before the formation of the neck in the outer member. As shown in the Figures, the shell casing 120 comprises an outer member 122 and an inner member 124. The outer member 122 is generally tubular, having an open forward end 126, an open rearward end 128, and a central passage 130. There is a circumferentially extending, forwardly facing seat 132 in the rearward portion of the central passage 130. An extractor groove 134 can be formed in the exterior of the outer member 122, adjacent to, but spaced from the rearward end. The extractor groove 134 forms a rim 136 on the outer member 122, at the rearward end.

As shown in FIG. 6, the outer member 122 preferably has a shoulder 138 adjacent the forward end 126, forming a neck portion 140 at the forward end of the outer member, of a smaller diameter than the outer member rearward of the shoulder. The shoulder 138 may be flat (as shown) or convexly curved or bowed. The sidewall of the outer member 122 is preferably thicker adjacent the rearward end. The outside surface of the outer member 122 is preferably smooth and continues between the groove 134 and the shoulder 138. Thus the inside surface of the outer member has a sloped shoulder 141 defining the area 143 of increased thickness.

The outer member 122 can be formed of a light weight material, preferably aluminum or an aluminum alloy. The outer member can be quickly and inexpensively formed by drawing.

The inner member 124 is disposed in the rearward end of the central passage 130 of the outer member 122. The inner member 124 comprises a forwardly facing cup-shaped portion 142, with a thick base 144. There is a port 146 between in the bottom of the forwardly facing cup portion 142. The forward most section 148 of the of the cup-shaped portion 142 preferably tapers in thickness to the forward edge, and preferably flares radially outwardly. The forward most section 148 is preferably aligned with sloped shoulder 141 on the inside surface of the outer member 122. The two pieces are preferably friction fit, but the two pieces could be joined, for example with an adhesive, or a sealant, or by some sort of intermetallic bonding to help reduce the infiltration of combustions gases between the inner and outer members.

The interfit between the inner member 124 and the outer member 122 preferably helps resist infiltration of combustion gasses between the inner and outer members which could deform the casing and/or interfere with the function of the firearm firing the cartridge.

The inner member 124 is preferably made of a stronger, more temperature resistant alloy than the outer member 122. For example the inner member 24 could be made of steel, and preferably of a stainless steel. However the inner member could be of some other material, such as copper or copper alloys (such as brass or bronze), nickel or nickel alloys. The inner member can made by machining, cold forming (such as cold heading), or other suitable fabrication processes. The inner member 124 could even be made using a metal injection molding (MIM) process The casing 120 can be quickly and easily assembled from the separately manufactured outer member 122 and the separately manufactured inner member 124. The inner member 124 is seated in the outer member 122, with the forward most section 148 aligned with the sloped shoulder 141 on the inside surface of the outer member 122. The shoulder 140 can then be formed in the outer member 122.

The composite shell case 120 is then ready to be assembled into a cartridge by fitting a primer into the opening in the rear of the outer member, a charge of propellant into the cavity of the inner member 124, and a bullet into the forward opening of the outer member 122. Despite the fact that the inner member 124 extends a substantial portion of the length of the outer member 122, the composite casing 120 still weights less than a conventional.

Figure 10A:
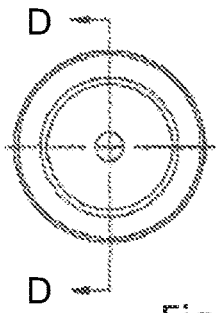
FIG. 10A is a top plan view of a third preferred embodiment of a compound shell casing, showing the inner member inside the outer member after formation of the neck in the outer member.
Figure 10B:
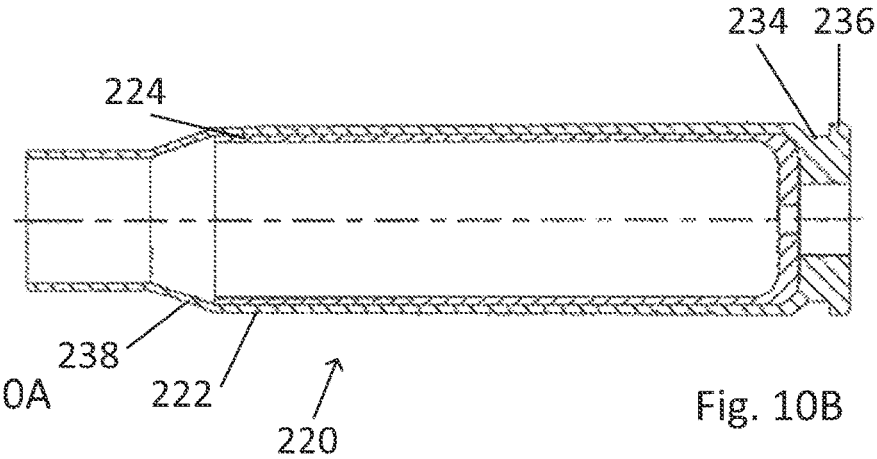
FIG. 10B is a longitudinal cross sectional view of the compound shell casing, taken along the plane of line D-D in FIG. 10A.
Figure 9A:
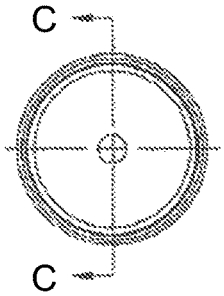
FIG. 9A is a top plan view of a third preferred embodiment of a compound shell casing, showing the inner member inside the outer member before formation of the neck in the outer member.
Figure 9B:
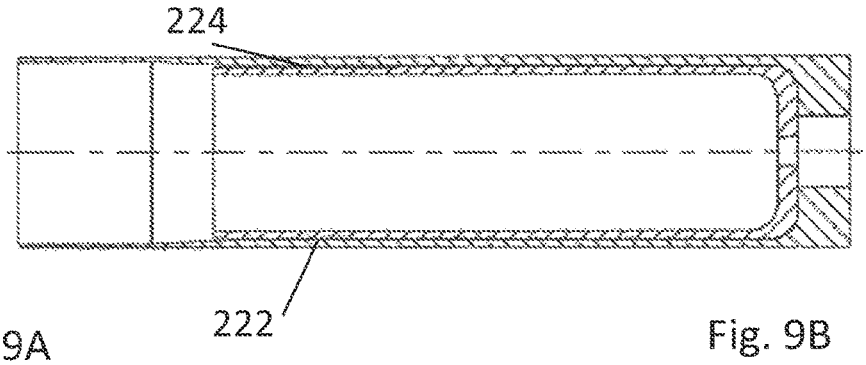
FIG. 9B is a longitudinal cross sectional view of the compound shell casing, taken along the plane of line C-C in FIG. 9A.
Figure 8A:
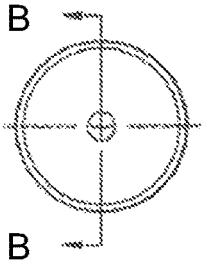
FIG. 8A is a top plan view of the inner member of the third preferred embodiment of a compound shell casing.
Figure 8B:
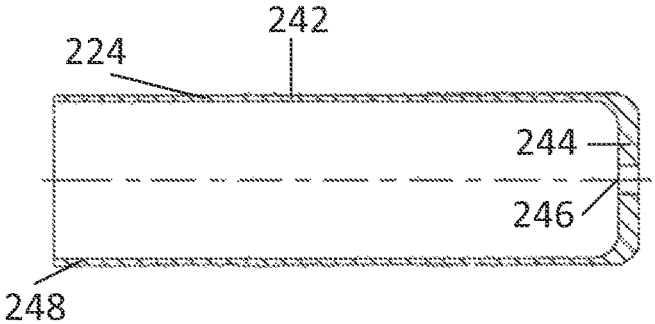
FIG. 8B is a longitudinal cross-sectional view of the inner member of the third preferred embodiment, take along the plane of line B-B in FIG. 8A.
Figure 7A:
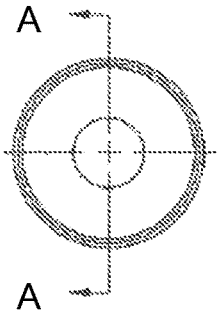
FIG. 7A is a top plan view of the outer member of a third preferred embodiment of a compound shell casing, before the formation of the neck in the outer member.
Figure 7B:
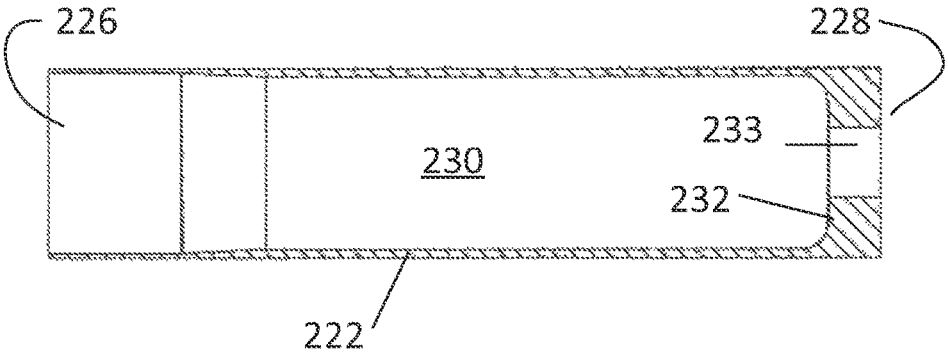
FIG. 7B is a longitudinal cross-sectional view of the outer member of the third preferred embodiment, take along the plane of line A-A in FIG. 7A.

A third preferred embodiment of a compound shell casing is indicated generally as 220 in FIGS. 7-10. FIG. 7 shows the outer member of the shell casing. FIG. 8 is the inner member of the shell casing. FIG. 9 shows the inner member disposed in the outer member, before a neck and extractor groove are formed in the outer member. FIG. 10 shows the completed shell casing/

As shown in the Figures, the shell casing 220 comprises an outer member 222 and an inner member 224. The outer member 222 is generally tubular, having an open forward end 226, an open rearward end 228, and a central passage 230. There is a circumferentially extending, forwardly and inwardly facing seat 232 in the rearward portion of the central passage 230. An opening 233 is formed in the rear of the outer member, for receiving a primer cup. An extractor groove 234 can be formed in the exterior of the outer member 222, adjacent to, but spaced from the rearward end. The extractor groove 234 forms a rim 236 on the outer member 222, at the rearward end.

As shown in FIG. 10, the outer member 222 preferably has a shoulder 238 adjacent the forward end 226, forming a neck portion 240 at the forward end of the outer member, of a smaller diameter than the outer member rearward of the shoulder. The shoulder 238 may be flat (as shown) or convexly curved or bowed. The outside surface of the outer member 222 is preferably smooth and continuous between the groove 234 and the shoulder 238. Similarly, the inside surface of the outer member 222 has a smooth, continuous surface from the shoulder 232 to the forward edge.

The outer member 222 can be formed of a light weight material, preferably aluminum or an aluminum alloy. The outer member can be quickly and inexpensively formed by drawing.

The inner member 224 is disposed in the rearward end of the central passage 230 of the outer member 222. The inner member 224 comprises a forwardly facing cup-shaped portion 242, with a thicker base 244. There is a port 246 in the bottom of the forwardly facing cup portion 242. The forward most section 248 of the cup-shaped portion 242 can taper in thickness to the forward edge, so that the combustion pressure deforms and seals the forward most section 248 of the inner member against the inside wall of the outer member.

The inner member 224 is preferably friction fit into the outer member 222, but the two pieces could be joined, for example with an adhesive, or a sealant, or by some sort of intermetallic bonding to help reduce the infiltration of combustions gases between the inner and outer members.

The inner member 224 is preferably made of a stronger, more temperature resistant alloy than the outer member 222. For example the inner member 224 could be made of steel, and preferably of a stainless steel. However the inner member could be of some other material, such as copper or copper alloys (such as brass or bronze), nickel or nickel alloys. The inner member can made by machining, cold forming (such as cold heading), or other suitable fabrication processes. The inner member 224 could even be made using a metal injection molding (MIM) process The casing 220 can be quickly and easily assembled from the separately manufactured outer member 222 and the separately manufactured inner member 224. The inner member 224 is seated in the outer member 222, the shoulder 238 can then be formed in the outer member 222.

The composite shell case 220 is then ready to be assembled into a cartridge by fitting a primer into the opening in the rear of the outer member, a charge of propellant into the cavity of the inner member 224, and a bullet into the forward opening of the outer member 222. Despite the fact that the inner member 224 extends a substantial portion of the length of the outer member 222, the composite casing 220 still weighs less than a conventional brass shell casing. The inner member 224 is preferably friction fit in the passage 230, but in some embodiments it could be secured by bonding or adhesives, or otherwise.

An alternate construction of a third preferred embodiment of a compound shell casing is indicated generally as 220' in FIGS. 11-14. FIG. 11 shows the outer member of the shell casing. FIG. 12 is the inner member of the shell casing. FIG. 13 shows the inner member disposed in the outer member, before a neck and extractor groove are formed in the outer member. FIG. 14 shows the completed shell casing.

As shown in the Figures, the shell casing 220' comprises an outer member 222' and an inner member 224'. Shell casing 220' is substantially similar to shell casing 220, with corresponding parts identified with corresponding reference numerals. However, unlike shell casing 220, the inner and outer members 222' and 224' have mating circular lip 250 and circular groove 252. The lip 250 is preferably formed on the bottom of the inner member 224' and the groove 252 is formed inside the interior of the outer member 222. The lip 250 and groove 252 help establish a seal between the inner and outer member to help resist the escape of combustion gas. There could be additional lips and groves, and/or some of the lips could be provided on the outer member 222' and some of the grooves could be provided on the inner member 224' to improve the engagement between the inner and outer members. In addition an adhesive or sealing could be provided in at least one of the grooves 252 or on one of the lips 250.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A compound shell casing comprising:

a generally tubular outer member having an open forward end forming the forward end of the casing, an open rearward end forming the rearward end of the casing, and a central passage extending therebetween, the central passage having a forward end and a rearward end, with a circumferentially extending, forwardly and inwardly facing seat in the rearward end of the central passage;

an inner member disposed in the rearward end of the central passageway of the outer member, the inner member having a forward end and a rearward end and comprising a first forwardly facing cup-shaped portion, and a second, rearwardly facing cup-shaped portion opening to the open rearward end of the outer member, and a circumferentially extending downwardly and rearwardly facing shoulder on the exterior of the inner member engaging the seat in the central passage of the outer member, wherein the rearward end of the inner member is substantially flush with the rearward end of the outer member, forming a part of the rearward end of the compound shell casing.

2. The compound shell casing according to claim 1, wherein the outer member has a shoulder adjacent the forward end, forming a neck portion at the forward end of the outer member, of a smaller diameter than the outer member rearward of the shoulder.

3. The compound shell casing according to claim 1 further comprising an extractor groove in the outer member adjacent the rearward end, defining a rim at the rearward end of the outer member.

4. The compound shell casing according to claim 1 wherein the outer member and the inner member are made of a metal lighter than brass.

5. The compound shell casing according to claim 4 wherein the outer member and the inner member are made of aluminum.

6. A compound shell casing comprising:

a generally tubular outer member having an open forward end forming the forward end of the casing, an open rearward end forming the rearward end of the casing, and a central passage extending therebetween, the central passage having a forward end and a rearward end with a circumferentially extending, forwardly and inwardly facing seat in the rearward end of the central passage, and an extractor groove in the outer member adjacent the rearward end, defining a rim at the rearward end of the outer member;

an inner member having a forward end and a rearward end disposed in the rearward end of the central passage of the outer member, the inner member comprising a first forwardly facing cup-shaped portion, and a second, rearwardly facing cup-shaped portion opening to the open rearward end of the outer member with the rearward end of the inner member being substantially flush with the rearward end of the outer member, forming a part of the rearward end of the compound shell casing, and a circumferentially extending downwardly and rearwardly facing shoulder on the exterior of inner member engaging the seat in the central passage of the outer member.

7. The compound shell casing according to claim 6 wherein the outer member and the inner member are made of a metal lighter than brass.

8. The compound shell casing according to claim 7 wherein the outer member and the inner member are made of aluminum.

9. The compound shell casing according to claim 6, wherein the outer member has a shoulder adjacent the forward end, forming a neck portion at the forward end of the outer member, of a smaller diameter than the outer member rearward of the shoulder.

10. The compound shell casing according to claim 9 wherein the outer member and the inner member are made of a metal lighter than brass.

11. The compound shell casing according to claim 10 wherein the outer member and the inner member are made of aluminum.

12. An ammunition cartridge comprising:

a composite shell casing having a generally tubular outer member having an open forward end forming the forward end of the casing, an open rearward end forming the rearward end of the casing, and a central passage extending therebetween, the central passage having a forward end and a rearward end, with a circumferentially extending, forwardly and inwardly facing seat in the rearward end of the central passage, and an extractor groove in the outer member adjacent the rearward end, defining a rim at the rearward end of the outer member; an inner member having a forward end and a rearward end and disposed in the rearward end of the central passage of the outer member, the inner member comprising a first forwardly facing cup-shaped portion, and a second, rearwardly facing cup-shaped portion opening to the open rearward end of the outer member with the rearward end of the inner member being substantially flush with the rearward end of the outer member, forming a part of the rearward end of the cartridge, and a circumferentially extending downwardly and rearwardly facing shoulder on the exterior of inner member engaging the seat in the central passage of the outer member;

a primer disposed in the second, rearwardly facing cup-shaped portion;

propellant disposed in the first forwardly facing cup-shaped portion; and a bullet disposed in the open forward end of the outer member.

* * * * *